US005370146A

United States Patent [19]

King et al.

[11] Patent Number: 5,370,146

[45] Date of Patent: Dec. 6, 1994

[54] SAMPLE VALVE

[75] Inventors: Gerald V. King, Odem; Thomas M. Kenesson, Corpus Christi, both of Tex.

[73] Assignee: Hoechst Celanese Corporation, Somerville, N.J.

[21] Appl. No.: 32,875

[22] Filed: Mar. 18, 1993

[51] Int. Cl.[5] ..... F17D 3/01; B08B 3/04; B08B 9/06

[52] U.S. Cl. ..... 137/8; 73/863.86; 134/166 C; 134/171; 137/15; 137/238; 137/240; 137/244; 251/122

[58] Field of Search ..... 137/238, 244, 605, 861, 137/862, 240, 8, 15; 73/863.86; 251/122, 205, 208, 209; 15/104; 134/166 R, 166 C, 171

[56] References Cited

U.S. PATENT DOCUMENTS

| | | | |
|---|---|---|---|
| 1,358,968 | 11/1920 | Mattern et al. | 137/240 |
| 1,924,498 | 8/1933 | House | 137/240 |
| 2,682,277 | 6/1954 | Marshall et al. | 137/334 |
| 2,881,783 | 4/1959 | Andrews | 137/244 |
| 3,033,657 | 5/1962 | Smith | 137/240 |
| 3,716,346 | 2/1973 | Greene | 137/605 |
| 3,744,512 | 7/1973 | Billman | 137/238 |
| 4,026,324 | 5/1977 | King et al. | 137/605 |
| 4,195,654 | 4/1980 | Coley | 137/605 |
| 4,281,935 | 8/1981 | Cramer et al. | 251/145 |
| 4,344,453 | 8/1982 | Tuchenhagen et al. | 137/240 |
| 4,458,543 | 7/1984 | Meith | 137/240 |

*Primary Examiner*—George L. Walton

*Attorney, Agent, or Firm*—James J. Mullen; Donald R. Cassady

[57] ABSTRACT

A valve for obtaining a sample from a continuous flow of fluid includes a primary flow path for directing a continual flow of the fluid through the valve, a valve stem which engages a passage in a valve seat for metering a sample of fluid passing through the primary flow path out through a separate outlet passage in the valve. The valve further includes a passage separate from the primary flow path for injecting a purge gas into the sample outlet passage to remove any sample fluid contained in the outlet passage after the sample valve has been closed and before the sample container is taken off-line so as to avoid atmospheric emissions of the sample fluid.

16 Claims, 2 Drawing Sheets

SAMPLE VALVE

BACKGROUND OF THE INVENTION

The present invention is directed to a novel valve used to remove a sample from a main line flow of fluid. More specifically, the present invention is directed to a novel sample valve which can remove a sample of fluid from a main line flow thereof without fluid being adversely emitted into the atmosphere and without creating excessive amounts of waste.

It is often necessary to take a sample of fluid from a main line fluid flow for testing, for example, to determine product quality such as to ascertain the levels of impurities and to quantify impurities, and to run quantitative analyses of product such as concentration, pH, etc. Samples are typically taken by diverting a small sample stream from the main line flow and directing same to a sample container and the like. For example, a T-connector has been included in a main line flow and used to divert a fluid sample to a valve which could be opened to direct a portion of the diverted fluid to a sample container or the like. Unfortunately, when taking fluid samples out of substantially continuous processing systems, there typically is removed excess fluid creating waste and, as well, there are often atmospheric emissions associated with the sampling process, in particular, when the sample container or the like is brought off-line. Thus, unsampled fluid remaining in the T-connector between the main line flow and the sample valve is excess which is often simply dumped from the system. If toxic, this waste can poison the environment in which it has been disposed. Stagnate fluid may also pose problems of corrosion or leakage, etc. Accordingly, the process of taking a sample from a main fluid flow is often uneconomical due to the waste which is formed and importantly, due to the substantial costs which accrue to prevent the occurrence of health and safety hazards which may be generated by atmospheric emissions of sampled fluid associated with the sampling process or assuage the consequences of such hazards.

An example of a valve which is used to take samples from a main line flow is disclosed in U.S. Pat. No. 4,281,935, issued Aug. 4, 1981. The valve disclosed in this patent comprises an inlet and an outlet for a main line fluid flow path through the valve and a valve stem which passes through the main flow and can be seated on a valve seat which extends into the main flow. The valve seat includes a passage communicating with the main flow and a passage out through a separate portion of the valve. The valve is disclosed as being primarily useful for injecting a fluid into the main flow path via the passage in the valve seat but, the patent also discloses that the valve may be used to remove sample material from the main flow path by applying a vacuum at the separate valve outlet which communicates with the passage in the valve seat. This patent, however, does not remotely disclose the problems with respect to sample waste and environmental emissions of sampled fluid generated during the sampling process and accordingly, does not disclose a particular valve structure which may offer a solution to the problems addressed above.

Accordingly, a primary objective of the present invention is to provide a means for removing a sample from a fluid stream in an environmentally safe manner.

Another objective of the present invention is to provide a sample valve which can remove a small sample of a fluid from a main line fluid flow in an economical and environmentally safe manner in which atmospheric emissions from the diverted sample are avoided.

Still another object of the present invention is to provide a sample valve which is easy to manufacture and operate for removing a sample of fluid from a main line flow and which ensures the avoidance of emissions of the sampled fluid into the surrounding environment.

Yet another object of the invention is to provide a process for taking a sample of fluid from a substantially continuous main line fluid flow in an economical and environmentally safe manner.

SUMMARY OF THE INVENTION

To meet the objectives of the present invention and, thus, to overcome the problems discussed above with respect to removing a sample from a main line fluid flow economically and without environmental emissions, the present invention provides a novel sample valve. The novel sample valve includes a body member containing a primary fluid flow path therethrough from an inlet end to an outlet end, a valve stem connected to the body member and which is movable through the primary fluid flow path and into a passage within a valve seat located directly opposite the valve stem across the primary fluid flow path in the body member, the passage in the valve seat communicating with the primary fluid flow path and with a separate downstream outlet passage to form a sample flow path for transporting the sample fluid from the valve seat passage to a container for collecting the sample. Importantly, the novel sample valve of this invention contains in the valve body an additional purge fluid line including an inlet for receiving a purge fluid and an outlet which communicates with the sample flow path directly below the valve seat passage to allow the injection of a purging atmosphere into the sample flow path. The purging atmosphere purges sample fluid from the sample flow path into the sample container or any excess sample fluid into a separation means which collects and separates any excess sample fluid from the purge gas. Moreover, the valve stem can be configured to provide a metered flow of sample fluid from the primary flow path to greatly reduce waste and provide improved sample testing if a primary flow must be sampled over a relatively long period of time.

To obtain a sample of fluid from the primary fluid flow passing through the valve, the valve stem is raised to allow a sample of fluid from the primary flow path to flow through the passage in the valve seat, into the sample flow path in the valve body and out of the valve body to a flow path which communicates with the sample container. When a sufficient amount of sample has been collected, the valve stem is lowered to prohibit further flow of fluid from the primary flow path into the sample flow path. At that time, the purge inlet into the valve body is opened to a purging fluid which removes any sample fluid from the sample flow path and flushes same into the sample container. If the sample container is full, the purge fluid flushes the sample fluid into a secondary stream which directs the excess sample to a separation device for recycle. When the sample container is removed from the sample flow path in the valve body, there is no accumulated sample fluid within the sample flow path which can be emitted into the atmosphere and cause pollution and/or pose a health hazard.

DETAILED DESCRIPTION OF THE INVENTION

Figure 1:
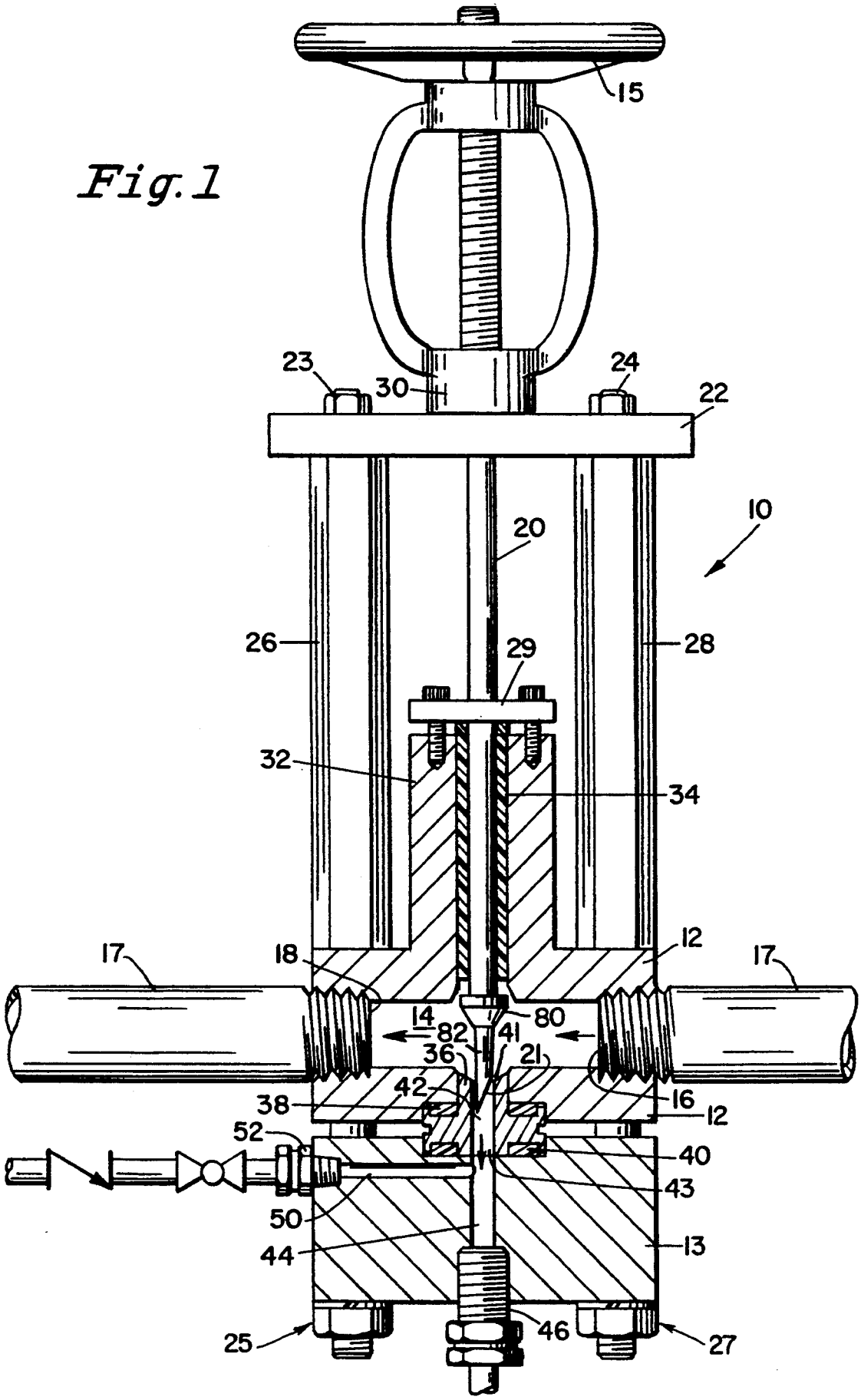
FIG. 1 is a partial cross-sectional view, partial elevation of the novel sample valve of the present invention.

Referring to FIG. 1, sample valve 10 containing the embodiments of the present invention includes an upper body 12 having a primary fluid flow path 14 therethrough from an inlet 16 to an outlet end 18 for connection to process piping 17. The sample valve of the present invention is able to remove a sample of any type of fluid flowing through the valve including liquids, gases and even slurries. The sample valve of the present invention is particularly useful in removing a sample of fluid which is flowing on a substantially continuous basis through piping 17 inasmuch as it is during the sampling of continuous flows do most problems with respect to generating waste and creating environmental and health hazards occur.

Sample valve 10 contains a valve control mechanism comprising a valve stem 20 which may be actuated by any type of mechanism such as hand operated wheel 15 connected to the upper end of valve stem 20. Valve stem 20 extends from handwheel 15 and is held by a yoke 22 which itself is supported by bolts 23 and 24 threaded through upper valve body 12 and lower valve body 13. Bolts 23 and 24 are placed through guide spacer columns 26 and 28 extending from yoke 22 to upper valve body 12. Nut assemblies 25 and 27 secure bolts 23 and 24, respectively. Yoke 22 includes a bushing 30 through which the upper portion of valve stem 20 advances as it is rotated. At the lower end, valve stem 20 extends through a second yoke assembly 29 and a passage within a packing gland 32 which secures yoke assembly 29. Packing gland 32 is lined with a friction-resistant material such as a teflon liner 34. Valve stem 20 extends through the passage in packing gland 32 and through primary flow path 14 in upper valve body 12.

Sample valve 10 further includes a valve seat 36 located directly opposite valve stem 20 and across primary flow path 14 such that the upper valving portion 80 of valve stem 20 passes through flow path 14 and into association with valve seat 36. Valve seat 36 can be threaded or otherwise secured to upper valve body 12. Gasket 38 can be used to tightly seal the valve seat against the upper valve body 12 to prevent leakage. An additional gasket 40 can also be used to seal the valve seat 36 to lower valve body 13. Within valve seat 36, there is a passage 42 which communicates with the primary flow path 14 at valve seat passage inlet 41 and with downstream outlet bore 44 at valve seat passage outlet 43 and formed within lower valve body 13. Pipe fitting 46 can be threaded to lower valve body 13 to secure downstream piping communication with bore 44. Valve seat passage 42 and outlet bore 44 form a sample flow path through valve 10.

To ensure that sample fluid is removed from the sample flow path prior to taking the sample container offline, sample valve 10 is further provided with purge passage 50 which communicates with bore 44 directly below valve seat 36. The purge passage 50 includes an inlet pipe fitting 52 through which can flow a metered amount of an inert purge fluid such as nitrogen gas.

Figure 2:
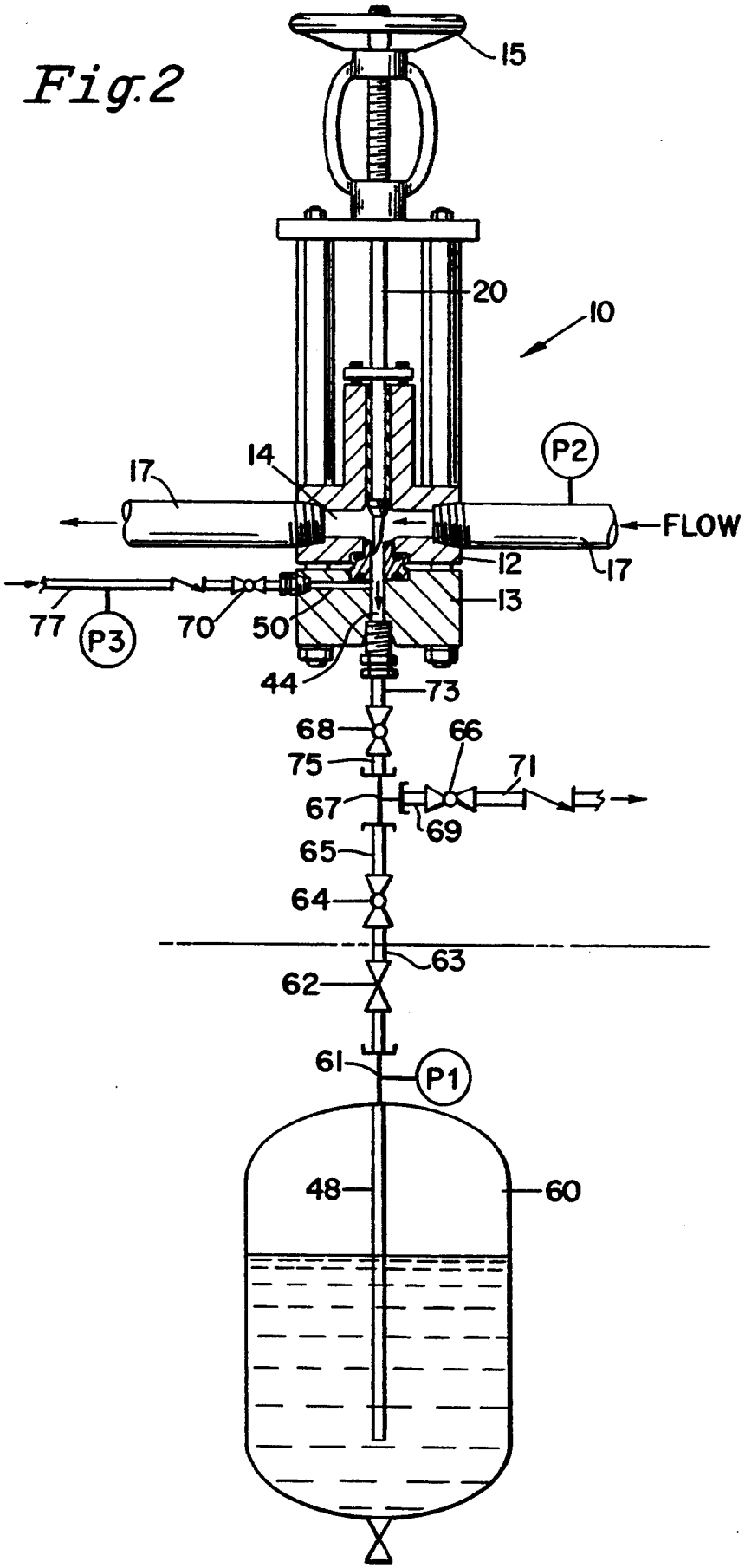
FIG. 2 is an overall schematic view of the novel sample valve and the attachment thereto of a sample container.

Valve 10 can be further understood when discussed in conjunction with the operation of the valve in obtaining a fluid sample from the primary fluid flow which continuously passes through the valve. FIG. 2 illustrates the apparatus scheme used to obtain a fluid sample using valve 10 and for directing such sample into a sample container 60. Valve 10 is secured to piping 17 to ensure that the fluid flow in piping 17 continuously passes through primary flow path 14 of sample valve 10. Thus, the inlet 16 and outlet 18 of primary flow path 14 are secured to the piping 17 to allow for the continuous flow of fluid through valve 10. A sample container 60 having attached thereto an upstream container gate valve 62 is secured downstream of a sample station gate valve 64. Piping 61 and 63 connect sample container 60 to container valve 62 and container valve 62 to station valve 64, respectively. Separation gate valve 66 upstream of station valve 64 and connected thereto via piping 65, tee 67, and piping 69 regulates the flow of purge fluid and excess fluid sample into a separation device (not shown) via piping 71. An outlet gate valve 68 downstream of outlet bore 44 controls the flow of sample fluid taken from the sample fluid flow path in valve 10 and passing through piping 73. Piping 75 connects outlet valve 68 with tee 67. A purge gate valve 70 regulates the amount of purge fluid such as nitrogen gas passing into purge line 50 from piping 77.

Obtaining the fluid sample is as follows. Once container 60 containing valve 62 is connected to sample station valve 64, valves 62, 64, 68 and valve 10 are opened. Valve 10 is opened by turning handwheel 15 sufficiently to lift the upper valving portion 80 of valve stem 20 from a closed position in valve seat 36 allowing a sample of fluid to flow from the primary flow path 14 into passage 42 in valve seat 36. Accordingly, sample fluid is taken from the primary fluid flow path 14 through the sample flow path and eventually into container 60 by the associated downstream piping and opened valves 68, 64 and 62. At this point, the sample container pressure indicated as P1 is allowed to equalize to the process pressure in piping 17 as indicated by P2. Once pressures P1 and P2 have been equalized, valve 10 is closed by again fully seating upper valving portion 80 of valve stem 20 in valve seat 36. Subsequent to closing valve 10, valve 70 is opened to allow a purge gas such as nitrogen to sweep the sample fluid from the sample flow path including outlet bore 44 and downstream valves 68, 64 and 62 and associated piping and into container 60. The sample container pressure P1 is allowed to equalize with the nitrogen purge pressure P3 in piping 77. Preferably, the nitrogen purge pressure P3 should be set higher than the process pressure P2. Once pressures P1 and P3 are equalized, valve 62 is closed stopping the flow of sample fluid and purge gas into container 60. Subsequent to closing valve 62, valve 66 is opened for a sufficient period of time to allow the sample flow path to be purged of sample fluid. This excess sample fluid can be sent to a separation device via piping 71 and recycled, if desired. At this time, the valve 70 to purge line 50 is closed and as well valves 68, 64 and 66 are closed. Once all of these valves have been closed, the sample container 60 can be disconnected from the sample station. Since all the flow passages have been purged with nitrogen or any other inert purge fluid, when sample container 60 is disconnected, there is no residue of sample fluid remaining in the lines which can pose an environmental or health hazard by being emitted into the atmosphere.

Sampled fluids may be volatile or otherwise unstable. In such instances, sample fluid enters sample container 60 through a dip tube 48 near the bottom of container 60. A gas blanket is allowed to remain at the container inlet to trap volatile material. This may be useful when sampling ammonia, for example.

As previously discussed, the fluid which can be sampled using the novel sample valve 10 of the present invention can be any kind of fluid including a slurry which comprises particulate solids carried within a liquid stream. The valve stem 20 shown in FIG. 1 is particularly useful for sampling a slurry which is passing through the primary flow path 14. Thus, at the end of valve stem 20, below upper valving portion 80 is a cleaning component comprising cut-away portion 21 shown as a diagonal cut across the entire width of valve stem 20. If a slurry is being sampled, there may result a segregation of the slurry solids from the liquid carrier stream. These segregated solids can attach to the valve stem and further accumulate blocking passage 42 in valve seat 36. By allowing a continuous primary flow of slurry to pass through the valve, much of the accumulated solids are washed through primary flow path 14 and out of valve 10 and do not pose a problem. On the other hand, accumulated solids which plug passage 42 and valve seat 36 have to be removed for effective sampling of the slurry. If plugging occurs, the valve stem 20 can be raised such that the cut-away portion 21 of the valve stem is in communication with the primary flow path 14. This causes a larger flow path to be formed at the inlet of the valve seat and allows the slurry to be flushed through the passage. Once the accumulated material is flushed through the valve, valve seat 20 can again be lowered to a more desired setting to provide a metered flow of sample through the sample flow path. The valve stem for sampling a slurry shown in FIG. 1 herein is more fully described in conjunction with a slurry metering valve disclosed in a commonly assigned, copending application filed concurrently herewith as U.S. Ser. No. 032,871, filed Mar. 18, 1993. Slurries such as pharmaceutical products from a reactor or organic monomeric species being directed to reaction are among the many types of slurries which can be sampled and are usually provided in continuous fluid streams.

The valve stem 20 is preferably configured to provide a metered flow of fluid from primary flow path 14. Thus, valve stem 20 can be provided with a gradual downstream narrowing taper, as conventional, on a metering portion 82 of the valve stem between upper valving portion 80 and cut away portion 21 and which can be placed in communication with valve seat passage 42. A metered flow as opposed to on-off flow is advantageous when the primary flow must be sampled over a relatively long period of time. A continuous metered sample flow may provide improved testing accuracy and less sample excess than an intermittent on-off flow.

The novel construction of valve 10 of the present invention facilitates removal of a sample from a substantially continuous flow without process shut-down and without the disadvantageous environmental emissions which have plagued previous sampling processes. While valve 10 has been described as useful for obtaining a smaller sample from a primary flow, in a similar fashion, the valve may be used to inject a sample material into the primary flow path by attachment of an injection device to the outlet bore 48 and by applying a positive pressure to inject the fluid though the valve seat passage 42 and into the primary flow path 14.

What is claimed is:

1. A sample valve comprising:

a valve body having a primary flow path therethrough from an inlet end to an outlet end, a valve stem connected to said valve body and movable through said primary flow path, a valve seat located across said primary flow path and directly opposite said valve stem in said valve body, said valve seat having a passage therethrough communicating with said primary flow path at a valve seat passage inlet and with a sample outlet passable in said valve body at a valve seat passage outlet, said sample outlet passage containing an outlet from said valve body separate from said outlet of said primary flow path, said valve stem comprising an upper valving portion for seating and unseating in said valve seat for controlling fluid flow through said valve seat passage, said valve stem further comprising a lower portion which is movable through said primary flow path and said valve seat passage, said lower portion of said valve stem containing a metering component and a cleaning component, said metering component including a gradual downstream taper to provide control of fluid flow volume through said valve seat passage when said metering component is placed at said valve seat passage inlet, said cleaning component being below said metering component and having a cut-away portion substantially narrower than said metering component to allow greater fluid flow from said primary flow path to effectively flush and remove accumulated solids from said valve seat passage when said cleaning component is placed at said valve seat passage inlet, said valve body further including a separate purge fluid passage comprising a bore substantially wholly contained in said valve body and containing an inlet separate from said inlet of said primary flow path and a purge fluid outlet opening directly into said sample outlet passage adjacent and downstream of said valve seat passage outlet.

2. The sample valve of claim 1 wherein said cleaning component is formed by a diagonal cut across the width of said valve stem.

3. The sample valve of claim 1 wherein said valve body includes an upper valve body containing said primary flow path and a lower valve body containing said sample outlet passage, said valve seat placed intermediate said upper valve body and lower valve body.

4. The sample valve of claim 3 wherein said lower valve body further contains said separate purge fluid passage.

5. The sample valve of claim 1 further including a sample container spaced from said sample valve and a sample fluid flow path communicating with said separate outlet passage and said sample container.

6. The sample valve of claim 5 further including an excess sample flow path communicating with said sample fluid flow path downstream of said sample outlet passage and separate from said sample container.

7. A process for directing a sample from a continuous flow of fluid to a sample container comprising; passing said continuous flow of fluid through a sample valve which contains a valve body, said valve body containing a primary flow path therethrough from an inlet end to an outlet end, a valve stem connected to said valve body and movable through said primary flow path, a valve seat located across said primary flow path and directly opposite said valve stem in said valve body, said valve seat containing a passage therethrough communicating with said primary flow path at a valve seat passage inlet and with a sample outlet passage separate from said primary flow path at a valve seat passage outlet, said valve stem comprising an upper valving portion for seating and unseating in said valve seat for controlling fluid flow through said valve seat passage, said valve stem further comprising a lower portion below said upper valving portion which is moveable through said primary flow path and said valve seat passage and containing a metering component and a cleaning component, said metering component including a gradual downstream taper to allow control of fluid flow volume through said valve seat passage when said metering component is placed at said valve seat passage inlet, said cleaning component being below said metering component and comprising a cut-away portion substantially narrower than said metering component to allow greater fluid flow from said primary flow path to effectively flush and remove accumulated solids from said valve seat passage when said cleaning component is placed at said valve passage inlet, said continuous flow of fluid passing through said primary flow path, removing a portion of said continuous fluid flow from said primary flow path and directing said removed portion through said sample outlet passage by unseating said upper valving portion from said valve seat and placing said metering component at said valve seat passage inlet, directing said removed portion from said sample outlet passage to a sample container, stopping said removed fluid flow from said primary flow path when a sufficient amount of removed fluid has been collected in said sample container by seating said upper valving portion in said valve seat, said valve body further including a purge fluid passage comprising a bore substantially wholly contained in said valve body and containing an inlet separate from said inlet of said primary flow path and a purge fluid outlet communicating with said sample outlet passage, purging said sample outlet passage with a purge fluid supplied from said purge fluid passage to remove fluid from said sample outlet passage when said upper valving portion is seated in said valve seat, and periodically placing said cleaning component at said valve seat passage inlet to flush accumulated solids through said valve seat passage.

8. The process of claim 7 further comprising removing said sample container from communication with said sample outlet passage subsequent to purging said sample outlet passage with said purge fluid.

9. The process of claim 7 wherein said purge fluid is an inert atmosphere.

10. The process of claim 9 wherein said purge fluid is nitrogen gas.

11. The process of claim 7 wherein said purge fluid passage opens directly into said sample outlet passage adjacent and downstream of said valve seat passage.

12. The process of claim 7 further comprising directing a portion of said removed fluid and said purge fluid from said sample outlet passage to a separation device subsequent to when a sufficient amount of fluid has been collected in said container.

13. The process of claim 7 wherein said continuous fluid is a slurry.

14. The process of claim 7 wherein said continuous fluid is a gas.

15. The process of claim 13 wherein said slurry includes pharmaceutically active solids in a liquid carrier.

16. The process of claim 13 wherein said slurry includes organic monomeric solids in a liquid carrier.

* * * * *